US007315110B2

(12) United States Patent
Yoshida

(10) Patent No.: US 7,315,110 B2
(45) Date of Patent: Jan. 1, 2008

(54) SPARK PLUG WITH EASY-TO-RECOGNIZE IDENTIFICATION MARKS

(75) Inventor: Koichi Yoshida, Nagoya (JP)

(73) Assignee: Denso Corporation (JP)

( * ) Notice: Subject to any disclaimer, the term of this patent is extended or adjusted under 35 U.S.C. 154(b) by 214 days.

(21) Appl. No.: 11/167,912

(22) Filed: Jun. 28, 2005

(65) Prior Publication Data

US 2005/0285495 A1 Dec. 29, 2005

(30) Foreign Application Priority Data

Jun. 28, 2004 (JP) ..... 2004-189992

(51) Int. Cl.
*H01T 13/20* (2006.01)

(52) U.S. Cl. ..... 313/143; 313/141

(58) Field of Classification Search ..... 313/118, 313/141, 143, 144

See application file for complete search history.

(56) References Cited

U.S. PATENT DOCUMENTS 3,145,319 A * 8/1964 Ross ..... 313/125
6,831,396 B2 * 12/2004 Nishikawa ..... 313/118

FOREIGN PATENT DOCUMENTS

| | | |
|---|---|---|
| JP | 49-1727 | 1/1974 |
| JP | 3078913 | 5/2001 |

* cited by examiner

*Primary Examiner*—Vip Patel
(74) *Attorney, Agent, or Firm*—Nixon & Vanderhye PC

(57) ABSTRACT

A spark plug according to the invention has a length and an outer side surface. The outer side surface includes a plurality of closed band-shaped regions arranged in the lengthwise direction of the spark plug, within each of which a plurality of identical marks, which represent the same piece of information concerning the spark plug, are formed at predetermined intervals in a circumferential direction of the spark plug. Further, the marks within each of the regions represent the piece of information different from that represented by the marks within any other one of the regions, and each of the marks within each of the regions is aligned in the lengthwise direction of the spark plug with one of the marks within any other one of the regions. With such formation of marks, the spark plug can be accurately identified without rotating it to a specific position during the identification process.

28 Claims, 4 Drawing Sheets

SPARK PLUG WITH EASY-TO-RECOGNIZE IDENTIFICATION MARKS

CROSS-REFERENCE TO RELATED APPLICATION

This application claims priority from Japanese Patent Application No. 2004-189992, filed on Jun. 28, 2004, the content of which is hereby incorporated by reference into this application.

BACKGROUND OF THE INVENTION

1. Technical Field of the Invention

The present invention relates generally to spark plugs for igniting the air/fuel mixture within a combustion chamber of an engine.

More particularly, the invention relates to a spark plug that has easy-to-recognize identification marks formed thereon, through which the spark plug can be easily differentiated from other spark plugs.

2. Description of the Related Art

Many products, including spark plugs for internal combustion engines, generally have identification marks formed thereon, which serve various purposes.

For example, identification marks may be used to provide information about the manufacturer and the type of product. Identification marks may also be used to indicate the serial number or batch code of the product.

A number of methods have been proposed to apply identification marks to products.

Japanese Utility Model First Publication No. S49-1727 describes a method of applying an identification mark to a spark plug. According to the method, one of the terminal, housing (or metal shell), and insulator of the spark plug is designed to have a specific color that is indicative of the heat range of the spark plug. In other words, an identification mark is applied to the spark plug in the form of color.

However, in the above case, since the number of colors available is limited, it is difficult to provide more information about the spark plug so as to easily identify it among various types of spark plugs.

Japanese Utility Model No. 3078913 describes a ceramic catalyst support that is cylindrical in shape and has identification marks engraved on the outer side surface thereof with a laser beam.

In the above support, the identification marks are formed occupying only a certain angular range, not the whole angular range in the circumferential direction of the support. Consequently, in some cases, it is required to rotate the support to a suitable position where the identification marks can be accurately recognized by a recognition device.

Accordingly, to identify the above support, an additional apparatus (or device) and time is required to perform the task of rotating the support to a suitable position, thus increasing manufacturing cost of the support.

SUMMARY OF THE INVENTION

The present invention has been made in view of the above-mentioned problem.

It is, therefore, a primary object of the present invention to provide a spark plug with easy-to-recognize identification marks that enable the spark plug to be accurately identified without rotating the spark plug to a specific position during the identification process.

According to a first aspect of the present invention, a spark plug is provided which has a length and an outer side surface, wherein a plurality of identical marks, which represent the same information concerning the spark plug, are formed at predetermined intervals in a circumferential direction of the spark plug within a closed band-shaped region on the outer side surface of the spark plug.

According to a second aspect of the present invention, a spark plug is provided which has a length and an outer side surface, wherein the outer side surface includes a plurality of closed band-shaped regions arranged in the lengthwise direction of the spark plug, within each of which a plurality of identical marks, which represent the same piece of information concerning the spark plug, are formed at predetermined intervals in a circumferential direction of the spark plug, and wherein the marks within each of the regions represent the piece of information different from that represented by the marks within any other one of the regions, and each of the marks within each of the regions is aligned in the lengthwise direction of the spark plug with one of the marks within any other one of the regions.

According to a third aspect of the present invention, a spark plug is provided which has a length and an outer side surface, wherein a mark, which represents information concerning the spark plug, is formed occupying a whole circumference of the spark plug within a closed band-shaped region on the outer side surface of the spark plug.

According to a fourth aspect of the present invention, a spark plug is provided which has a length and an outer side surface, wherein the outer side surface includes a plurality of closed band-shaped regions arranged in the lengthwise direction of the spark plug, within each of which a mark, which represents a piece of information concerning the spark plug, is formed occupying a whole circumference of the spark plug, and wherein the mark within each of the regions represents the piece of information different from that represented by the mark within any other one of the regions.

With the above-described formations of marks, the spark plugs according to the invention can be accurately identified without rotating it to a specific position during the identification process, thus eliminating any additional apparatus and time which otherwise is required to rotate it to the specific position.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
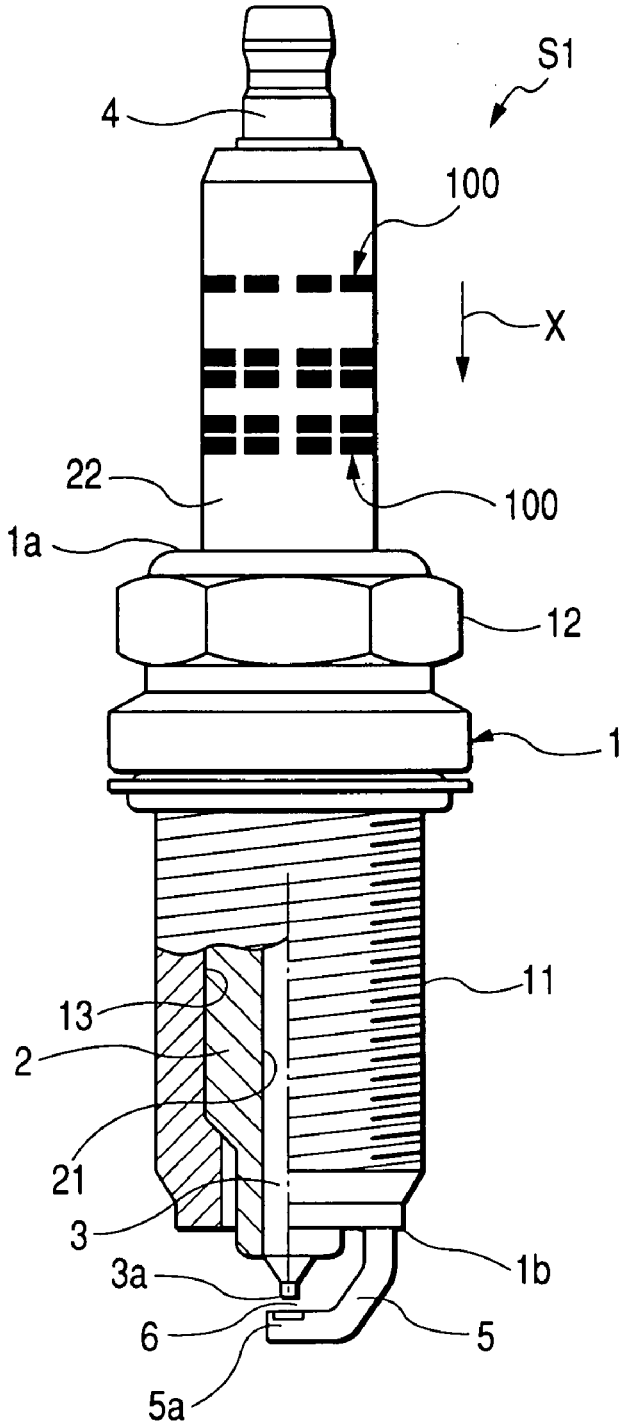
FIG. 1 is a partially cross-sectional side view showing the overall structure of a spark plug according to the first embodiment of the invention.

The preferred embodiments of the present invention will be described hereinafter with reference to FIGS. 1-6.

It should be noted that, for the sake of clarity and understanding, identical components having identical functions in different embodiments of the invention have been marked, where possible, with the same reference numerals in each of the figures.

First Embodiment

FIG. 1 shows the overall structure of a spark plug S1 according to the first embodiment of the invention. The spark plug S1 is designed for use in internal combustion engines of automotive vehicles.

As shown in FIG. 1, the spark plug S1 includes a metal shell 1, an insulator 2, a center electrode 3, a stem 4, and a ground electrode 5.

The tubular metal shell 1 is made of a conductive metal material, for example low-carbon steel. The metal shell 1 has a chamber 13 formed therein and a first end 1*a* and a second end 1*b* that is opposite to the first end 1*a* in the axial direction of the metal shell 1. The metal shell 1 also has a male threaded portion 11 on the outer periphery thereof and a hexagon head 12. The installation of the spark plug S1 in an internal combustion engine is achieved by fitting it into a combustion chamber (not shown) of the engine. More specifically, in the installation, the hexagon head 12 is torqued so as to establish an engagement between the male threaded portion 11 of the metal shell 1 and a female threaded bore provided in the cylinder head (not shown) of the combustion chamber.

The cylindrical insulator 2 is made of alumina ceramic ($Al_2O_3$). The insulator 2 is fixed and partially contained in the chamber 13 of the metal shell 1 such that an exposed portion 22 of the insulator 2 protrudes from the first end 1*a* of the metal shell 1. The insulator 2 has a bore 21 formed therethrough in the axial direction thereof.

The cylindrical center electrode 3 is made of a highly heat conductive metal material such as Cu as the core material and a highly heat-resistant, corrosion-resistant metal material such as a Ni (Nickel)-based alloy as the clad material. The center electrode 3 is fixed and partially contained in the bore 21 of the insulator 2, so that it is electrically isolated from the metal shell 1.

The cylindrical stem (i.e., terminal) 4 is also fixed and partially contained in the bore 21 of the insulator 2. The stem 4 is electrically connected with the center electrode 3.

The ground electrode 5 is made of a Ni-based alloy consisting mainly of Ni and approximately L-shaped. The ground electrode 5 is joined, for example by welding, to the second end 1*b* of the metal shell 1. The ground electrode 5 has a tip portion 5*a* that faces an end 3*a* of the center electrode 3 through a spark gap 6 in the lengthwise direction X of the spark plug S1.

The spark plug S1 is configured to discharge sparks in the spark gap 6 between the center electrode 3 and the ground electrode 5, thereby igniting the air/fuel mixture within a combustion chamber of an engine.

Having described the overall structure of the spark plug S1, formation of identification marks on the spark plug S1 will be described below.

As shown in FIG. 1, there are identification marks 100 formed on the outer surface of the exposed portion 22 of the insulator 2, which represent information about the type of the spark plug S1.

Figure 2:
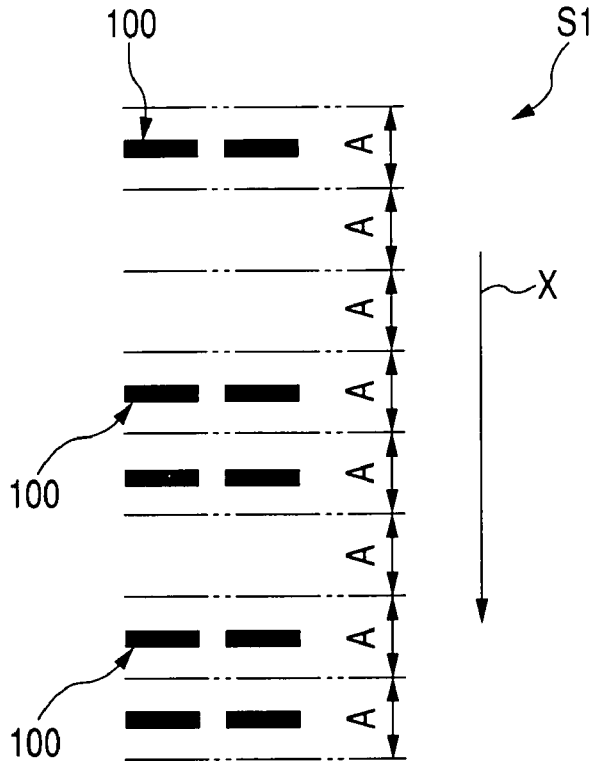
FIG. 2 is an enlarged view illustrating formation of identification marks on the outer side surface of the spark plug of FIG. 1.

Specifically, with reference to FIG. 2, there are eight annular regions on the outer surface of the exposed portion 22 of the insulator 2, which are arranged in the lengthwise direction X of the spark plug S1 and each have a predetermined width A.

Among the eight annular regions, five regions have the identification marks 100 formed thereon. Moreover, within each of those five regions, the identification marks 100 are formed at predetermined intervals in the circumferential direction of the spark plug S1. On the other hand, the other three regions have no identification marks 100 formed thereon.

Further, as shown in FIG. 2, each of the identification marks 100 within each of the five annular regions is aligned in the lengthwise direction X of the spark plug S1 with one of the identification marks 100 within any other one of the five annular regions.

In this embodiment, all the identification marks 100 are made identical and rectangular in shape. Consequently, the identification marks 100 within the same annular region together form a closed dashed-line in the circumferential direction of the spark plug S1.

Furthermore, in this embodiment, the presence or absence of the identification marks 100 within each of the eight annular regions represents a piece of information about the type of the spark plug S1. Accordingly, the identification marks 100 within the same annular region represent the same piece of information about the type of the spark plug S1, while those within different annular regions represent different pieces of the information about the type of the spark plug S1.

The information about the type of the spark plug S1 is particularly required when the spark plug S1 is to be installed in an engine on an assembly line.

Specifically, on the assembly line, a scanner is employed as a recognition device to recognize the identification marks 100 on the spark plug S1 that represent the information about the type of the spark plug S1, so as to prevent any mismatch of the spark plug S1 with an engine.

In practice, the scanner is moved along the lengthwise direction X of the spark plug S1 so as to perform scanning through all the eight annular regions. Based on the scanning results, a determination is made for each of the eight angular regions as to whether there are the identification marks 100 on the annular region. Further, based on the determination results, the type of the spark plug S1 is identified.

In order to ensure the scanning accuracy, the intervals between two adjacent identification marks 100 in the circumferential direction of the spark plug S1 are predetermined to be less than a scanning width of the scanner, so that the scanner can accurately recognize the presence or absence of the identification marks 100 within each of the eight annular regions.

Moreover, to set a starting point for the scanning, the first annular region (i.e., the one to be firstly scanned among the eight annular regions) is required to have the identification marks 100 formed thereon regardless of the type of the spark plug S1.

Consequently, a total of seven annular regions are available for representing the information about the type of the spark plug S1, and there are two alternatives of presence or absence for each of the seven annular regions. As a result, a total of 128 (i.e., $2^7$) different combinations are available for representation of different types of the spark plug S1.

To sum up, in the spark plug S1 according to the present embodiment, the outer surface of the exposed portion 22 of the insulator 2 includes a plurality of annular regions arranged in the lengthwise direction X of the spark plug S1, within each of which a plurality of identical identification marks 100, which represent the same piece of information about the type of the spark plug S1, are formed at the predetermined intervals in the circumferential direction of the spark plug S1.

Moreover, in the spark plug S1, the identification marks 100 within different annular regions represent different pieces of the information about the type of the spark plug S1, and each of the identification marks 100 within each of the annular regions is aligned in the lengthwise direction X of the spark plug S1 with one of the identification marks 100 within any other one of the annular regions.

With the above formation of the identification marks 100, the spark plug S1 can be accurately identified without rotating the spark plug S1 to a specific position during the identification process, thus eliminating any additional apparatus and time which otherwise is required to rotate the spark plug S1 to the specific position.

Moreover, since the outer surface of the exposed portion 22 of the insulator 2 has a relatively great area, it is possible to provide a lot of information concerning the spark plug S1 through the formation of the identification marks 100 thereon.

Second Embodiment

In this embodiment, a spark plug S2 is provided which has a structure identical to that of the spark plug S1 according to the previous embodiment, but a formation of identification marks thereon different from that on the spark plug S1.

Figure 3:
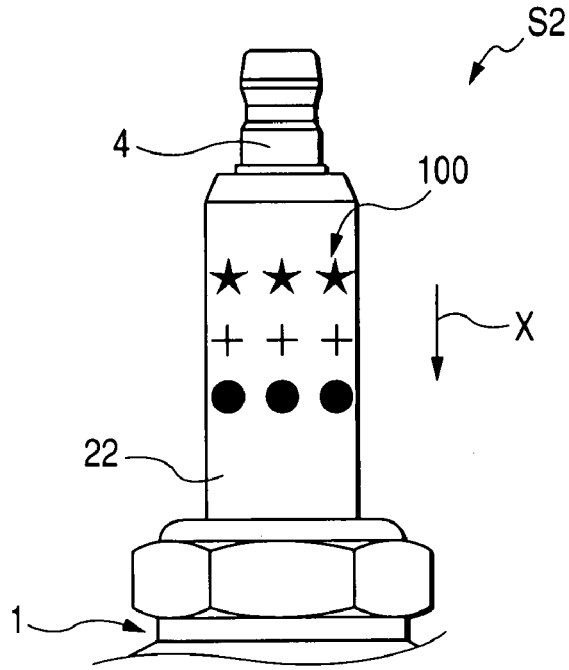
FIG. 3 is a view illustrating formation of identification marks on the outer side surface of a spark plug according to the second embodiment of the invention.

Referring to FIG. 3, in the spark plug S2 according to the present embodiment, the outer surface of the exposed portion 22 of the insulator 2 includes, for example, three annular regions arranged in the lengthwise direction X of the spark plug S1, within each of which identification marks 100 are formed at predetermined intervals in the circumferential direction of the spark plug S2.

Further, as shown in FIG. 2, the identification marks 100 within different annular regions have different shapes. Specifically, all the identification marks 100 within the first region have the shape of "★", those within the second region have the shape of "+", and those within the third region have the shape of "●", respectively.

Furthermore, each of the identification marks 100 within each of the three annular regions is aligned in the lengthwise direction X of the spark plug S2 with one of the identification marks 100 within any other one of the three annular regions.

Additionally, as in the previous embodiment, the intervals between two adjacent identification marks 100 in the circumferential direction of the spark plug S2 are also predetermined to be less than the scanning width of the scanner.

In the present embodiment, for each of the three annular regions, there are, for example, three alternatives of "★", "+", or "●" for the shape of identification marks 100. As a result, a total of 27 (i.e., $3^3$) different combinations are available for representation of different types of the spark plug S2.

Accordingly, when supposing that there are N different annular regions arranged on the outer surface of the exposed portion 22 of the insulator 2, and there are M alternatives for the shape of identification marks 100 for each of the N annular regions, then a total of $M^N$ (here, M and N are integer) different combinations are available for representation of different types of the spark plug S2.

Third Embodiment

In this embodiment, a spark plug S3 is provided which has a structure identical to that of the spark plug S1 according to the first embodiment, but a formation of identification marks thereon different from that on the spark plug S1.

Figure 4:
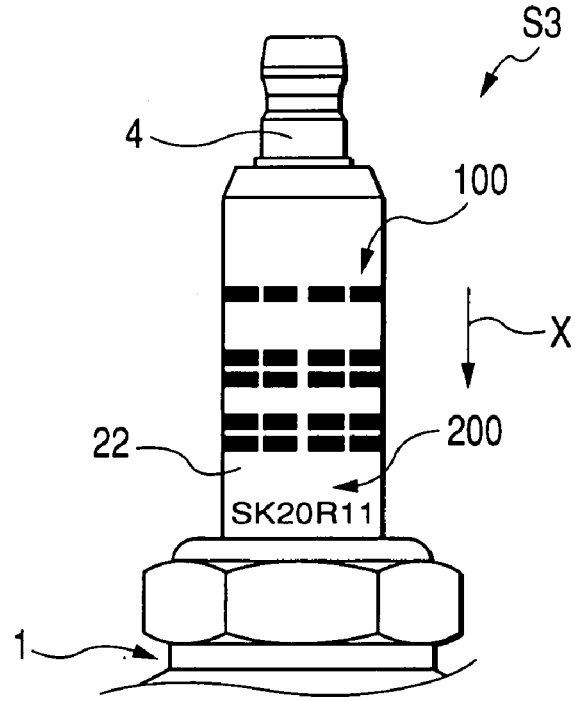
FIG. 4 is a view illustrating formation of identification marks on the outer side surface of a spark plug according to the third embodiment of the invention.

Referring to FIG. 4, the spark plug S3 according to the present embodiment includes identification marks 100 that are formed on the outer surface of the exposed portion 22 of the insulator 2 in the same way as in the first embodiment of the invention.

In addition to the identification marks 100, the spark plug S3 also includes an identification mark 200 that is formed on the outer surface of the exposed portion 22 of the insulator 2 and consists of an alphanumeric code.

The alphanumeric code directly indicates the type of the spark plug S3, while all the identification marks 100 together represent information about the type of the spark plug S3.

The alphanumeric code is to be visually read by an operator when it is impossible to automatically identify the type of the spark plug S3 due to failure of the scanner.

Fourth Embodiment

In this embodiment, a spark plug S4 is provided which has a structure identical to that of the spark plug S2 according to the second embodiment, but a formation of identification marks thereon different from that on the spark plug S2.

Figure 5:
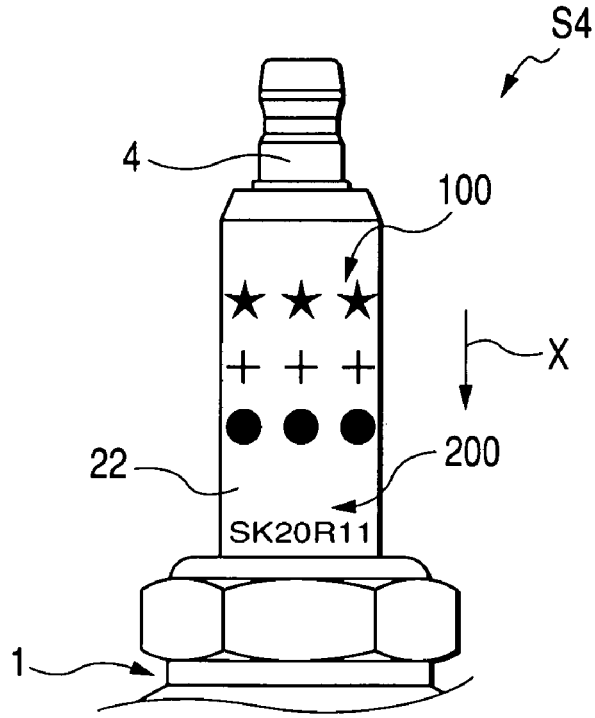
FIG. 5 is a view illustrating formation of identification marks on the outer side surface of a spark plug according to the fourth embodiment of the invention.

Referring to FIG. 5, the spark plug S4 according to the present embodiment includes identification marks 100 that are formed on the outer surface of the exposed portion 22 of the insulator 2 in the same way as in the second embodiment of the invention.

In addition to the identification marks 100, the spark plug S4 also includes an identification mark 200 that is formed on the outer surface of the exposed portion 22 of the insulator 2 and consists of an alphanumeric code.

The alphanumeric code directly indicates the type of the spark plug S4, while all the identification marks 100 together represent information about the type of the spark plug S4.

The alphanumeric code is to be visually read by an operator when it is impossible to automatically identify the type of the spark plug S4 due to failure of the scanner.

Fifth Embodiment

In this embodiment, a spark plug S5 is provided which has a structure and a formation of identification marks thereon almost identical to those of the spark plug S1 according to the first embodiment. Accordingly, only differences between the spark plugs S1 and S5 is to be described below.

Referring back to FIG. 1, in the spark plug S1, the exposed portion 22 of the insulator 2 has the smooth outer surface, and the identification marks 100 within the same annular region together form a closed dashed-line in the circumferential direction of the spark plug S1.

Figure 6A:
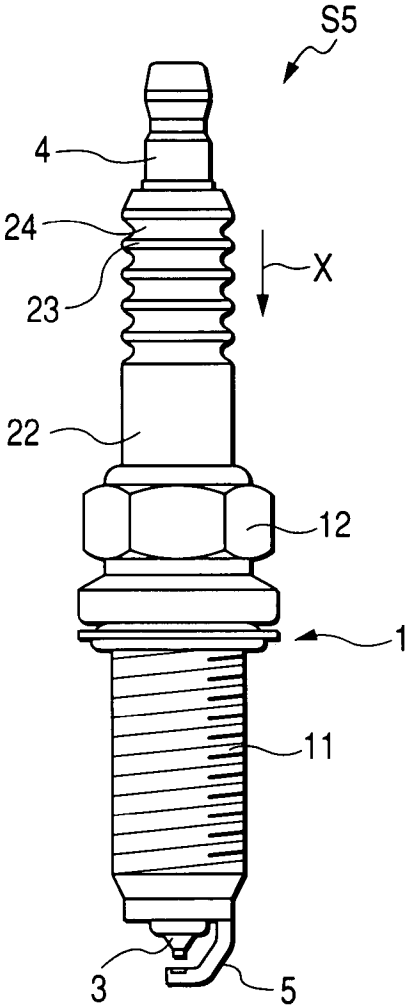
FIGS. 6A-6C are views illustrating formation of identification marks on the outer side surface of a spark plug according to the fifth embodiment of the invention.
Figure 6B:
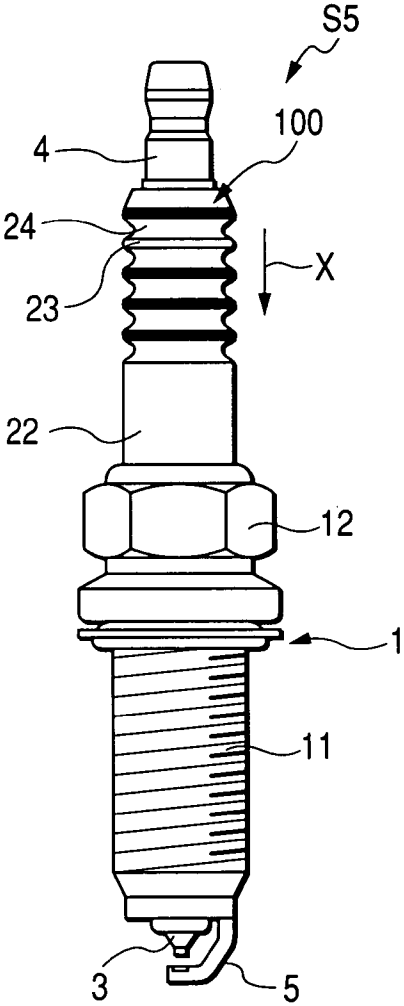
Figure 6C:
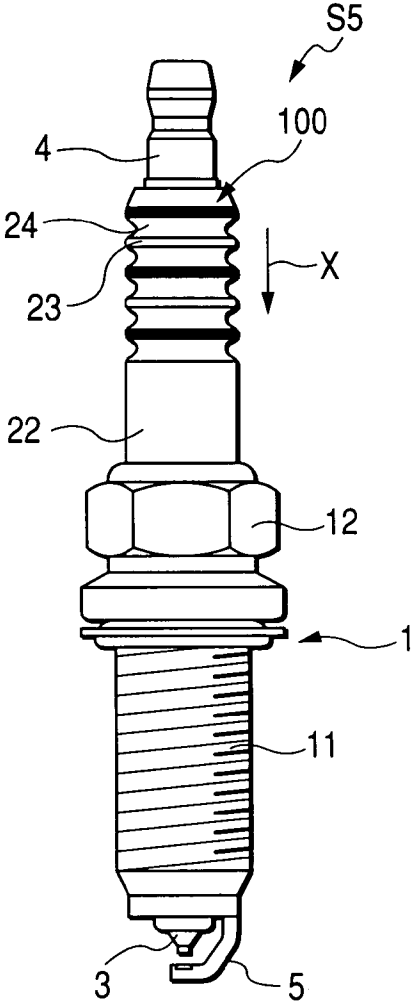

Referring now to FIGS. 6A-6C, in the spark plug S5, the outer surface of the exposed portion 22 of the insulator 2 is partially corrugated, so that five raised regions 23 and five recessed regions 24 are formed alternately in the lengthwise direction X of the spark plug S5. All the raised and recessed regions 23 and 24 have an annular shape.

Further, for each of the raised regions 23, the presence or absence of an identification mark 100, which is a continuous line. occupying a whole circumference of the spark plug S5, represents a piece of information about the type of the spark plug S5.

For example, in FIG. 6A, all the raised regions 23 have no identification marks 100 formed thereon. In FIG. 6B, only the second raised region 23 in the lengthwise direction X of the spark plug S5 has no identification marks 100 formed thereon. In FIG. 6C, the first, third, and fifth raised regions 23 in the lengthwise direction X of the spark plug S5 have the identification marks 100 formed thereon.

Accordingly, a total of 32 (i.e., $2^5$) different combinations are available for representation of different types of the spark plug S5.

Other Embodiments

While the above particular embodiments of the invention have been shown and described, it will be understood by those who practice the invention and those skilled in the art that various modifications, changes, and improvements may be made to the invention without departing from the spirit of the disclosed concept.

For example, in the previous embodiments of the invention, each of the identification marks 100 are formed to include a graphic symbol, such as a dashed or continuous line, a star, a plus symbol, and a circle.

However, each of the identification marks 100 may also be formed to include at least one character, for example a Chinese character. Otherwise, each of the identification marks 100 may also be formed to include an alphanumeric code, for example simply a numeral or an English letter.

Moreover, in the fifth embodiment of the invention, only an identification mark 100, which is a closed continuous line, is used to represent a piece of information about the type of the spark plug S5.

However, instead of the only one identification mark 100, a plurality of identical identification marks 100 as in the first to fourth embodiments of the invention may also be used to represent the piece of information about the type of the spark plug S5.

Such modifications, changes, and improvements within the skill of the art are intended to be covered by the appended claims.

What is claimed is:

1. A spark plug having a length and an outer side surface, wherein a plurality of identical marks, which represent the same information concerning the spark plug, are formed at predetermined intervals in a circumferential direction of the spark plug within a closed band-shaped region on the outer side surface of the spark plug.

2. The spark plug as set forth in claim 1, wherein each of the marks is formed to include at least one graphical symbol.

3. The spark plug as set forth in claim 1, wherein each of the marks is formed to include at least one character.

4. The spark plug as set forth in claim 1, wherein each of the marks is formed to include an alphanumeric code.

5. The spark plug as set forth in claim 1, wherein the spark plug comprises:

a tubular metal shell having a first end and a second end opposite to the first end in the lengthwise direction of the spark plug;

an insulator retained in said metal shell, said insulator having an exposed portion that protrudes from the first end of said metal shell;

a center electrode secured in said insulator, said center electrode having an end that protrudes from the second end of said metal shell; and a ground electrode joined to the second end of said metal shell, said ground electrode having a tip portion that faces the end of said center electrode through a spark gap in the lengthwise direction of the spark plug, and wherein the closed band-shaped region, within which the marks are formed, is provided on an outer surface of the exposed portion of said insulator.

6. The spark plug as set forth in claim 5, wherein the outer surface of the exposed portion of said insulator is partially corrugated in the lengthwise direction of the spark plug so that a plurality of raised regions and recessed regions, each of which has a shape in closed-band, are arranged alternately on the outer surface of the exposed portion of said insulator in the lengthwise direction of the spark plug, and wherein the closed band-shaped region, within which the marks are formed, is provided at one of the raised regions.

7. The spark plug as set forth in claim 1, wherein the information concerns a product type of the spark plug.

8. A spark plug having a length and an outer side surface, wherein the outer side surface includes a plurality of closed band-shaped regions arranged in the lengthwise direction of the spark plug, within each of which a plurality of identical marks, which represent the same piece of information concerning the spark plug, are formed at predetermined intervals in a circumferential direction of the spark plug, and wherein the marks within each of the regions represent the piece of information different from that represented by the marks within any other one of the regions, and each of the marks within each of the regions is aligned in the lengthwise direction of the spark plug with one of the marks within any other one of the regions.

9. The spark plug as set forth in claim 8, wherein each of the marks within at least one of the regions is formed to include at least one graphical symbol.

10. The spark plug as set forth in claim 8, wherein each of the marks within at least one of the regions is formed to include at least one character.

11. The spark plug as set forth in claim 8, wherein each of the marks within at least one of the regions is formed to include an alphanumeric code.

12. The spark plug as set forth in claim 8, wherein the spark plug comprises:

a tubular metal shell having a first end and a second end opposite to the first end in the lengthwise direction of the spark plug;

an insulator retained in said metal shell, said insulator having an exposed portion that protrudes from the first end of said metal shell;

a center electrode secured in said insulator, said center electrode having an end that protrudes from the second end of said metal shell; and a ground electrode joined to the second end of said metal shell, said ground electrode having a tip portion that faces the end of said center electrode through a spark gap in the lengthwise direction of the spark plug, and wherein all the closed band-shaped regions, within each of which the marks are formed, are provided on an outer surface of the exposed portion of said insulator.

13. The spark plug as set forth in claim 12, wherein the outer surface of the exposed portion of said insulator is partially corrugated in the lengthwise direction of the spark plug so that a plurality of raised regions and recessed regions, each of which has a shape in closed-band, are arranged alternately on the outer surface of the exposed portion of said insulator in the lengthwise direction of the spark plug, and wherein each of the closed band-shaped regions, within which the marks are formed, is provided at one of the raised regions.

14. The spark plug as set forth in claim 8, wherein the information concerns a product type of the spark plug.

15. A spark plug having a length and an outer side surface, wherein a mark, which represents information concerning the spark plug, is formed occupying a whole circumference of the spark plug within a closed band-shaped region on the outer side surface of the spark plug.

16. The spark plug as set forth in claim 15, wherein the mark is formed to include at least one graphical symbol.

17. The spark plug as set forth in claim 15, wherein the mark is formed to include at least one character.

18. The spark plug as set forth in claim 15, wherein the mark is formed to include an alphanumeric code.

19. The spark plug as set forth in claim 15, wherein the spark plug comprises:

a tubular metal shell having a first end and a second end opposite to the first end in the lengthwise direction of the spark plug;

an insulator retained in said metal shell, said insulator having an exposed portion that protrudes from the first end of said metal shell;

a center electrode secured in said insulator, said center electrode having an end that protrudes from the second end of said metal shell; and a ground electrode joined to -the second end of said metal shell, said ground electrode having a tip portion that faces the end of said center electrode through a spark gap in the lengthwise direction of the spark plug, and wherein the closed band-shaped region, within which the mark is formed, is provided on an outer surface of the exposed portion of said insulator.

20. The spark plug as set forth in claim 19, wherein the outer surface of the exposed portion of said insulator is partially corrugated in the lengthwise direction of the spark plug so that a plurality of raised regions and recessed regions, each of which has a shape in closed-band, are arranged alternately on the outer surface of the exposed portion of said insulator in the lengthwise direction of the spark plug, and wherein the closed band-shaped region, within which the mark is formed, is provided at one of the raised regions.

21. The spark plug as set forth in claim 15, wherein the information concerns a product type of the spark plug.

22. A spark plug having a length and an outer side surface, wherein the outer side surface includes a plurality of closed band-shaped regions arranged in the lengthwise direction of the spark plug, within each of which a mark, which represents a piece of information concerning the spark plug, is formed occupying a whole circumference of the spark plug, and wherein the mark within each of the regions represents the piece of information different from that represented by the mark within any other one of the regions.

23. The spark plug as set forth in claim 22, wherein at least one of the marks is formed to include at least one graphical symbol.

24. The spark plug as set forth in claim 22, wherein at least one of the marks is formed to include at least one character.

25. The spark plug as set forth in claim 22, wherein at least one of the marks is formed to include an alphanumeric code.

26. The spark plug as set forth in claim 22, wherein the spark plug comprises:

a tubular metal shell having a first end and a second end opposite to the first end in the lengthwise direction of the spark plug;

an insulator retained in said metal shell, said insulator having an exposed portion that protrudes from the first end of said metal shell;

a center electrode secured in said insulator, said center electrode having an end that protrudes from the second end of said metal shell; and a ground electrode joined to the second end of said metal shell, said ground electrode having a tip portion that faces the end of said center electrode through a spark gap in the lengthwise direction of the spark plug, and wherein all the closed band-shaped regions, within each of which the mark is formed, are provided on an outer surface of the exposed portion of said insulator.

27. The spark plug as set forth in claim 26, wherein the outer surface of the exposed portion of said insulator is partially corrugated in the lengthwise direction of the spark plug so that a plurality of raised regions and recessed regions, each of which has a shape in closed-band, are arranged alternately on the outer surface of the exposed portion of said insulator in the lengthwise direction of the spark plug, and wherein each of the closed band-shaped regions, within which the mark is formed, is provided at one of the raised regions.

28. The spark plug as set forth in claim 22, wherein the information concerns a product type of the spark plug.

* * * * *